US011980288B2

(12) United States Patent
Lundeen et al.

(10) Patent No.: US 11,980,288 B2
(45) Date of Patent: May 14, 2024

(54) LOCKING SYSTEM FOR RETRACTABLE AND REMOVABLE DELIVERY BIN

(71) Applicant: Ford Global Technologies, LLC, Dearborn, MI (US)

(72) Inventors: Kurt Michael Lundeen, Novi, MI (US); Raj Sohmshetty, Canton, MI (US); Ireneusz Trybula, South Lyon, MI (US); Sam Hoff, Hazel Park, IL (US)

(73) Assignee: Ford Global Technologies, LLC, Dearborn, MI (US)

( * ) Notice: Subject to any disclaimer, the term of this patent is extended or adjusted under 35 U.S.C. 154(b) by 240 days.

(21) Appl. No.: 17/659,837

(22) Filed: Apr. 19, 2022

(65) Prior Publication Data

US 2023/0329435 A1 Oct. 19, 2023

(51) Int. Cl.
*A47B 88/473* (2017.01)
*A47B 31/00* (2006.01)

(52) U.S. Cl.
CPC ..... *A47B 88/473* (2017.01); *A47B 31/00* (2013.01); *A47B 2031/003* (2013.01)

(58) Field of Classification Search
CPC . A47B 88/473; A47B 31/00; A47B 2031/003; A47G 2029/142; A47G 29/141
See application file for complete search history.

(56) References Cited

U.S. PATENT DOCUMENTS 3,490,823 A * 1/1970 Bardeau ..... A47B 88/487 312/270.3
3,698,782 A * 10/1972 Onori ..... A47B 55/00 312/351
3,905,662 A * 9/1975 Richmond ..... B62B 3/006 312/294
4,698,630 A 10/1987 Ellsberg
(Continued)

FOREIGN PATENT DOCUMENTS

CN 108472189 B * 4/2021 ..... A47B 31/00
DE 60213791 T2 * 8/2007 ..... E05G 1/04
(Continued)

OTHER PUBLICATIONS

Harloff Innovating Storage for Care, Med-Bin-Medication Carts, SL54BIN3-EKC-Med-Bin Cart.

*Primary Examiner* — Hanh V Tran
(74) *Attorney, Agent, or Firm* — Brandon Hicks; Eversheds Sutherland (US) LLP

(57) ABSTRACT

A locking system for retractable and removable bins, and methods of use thereof, are provided. The locking system includes a retractable latch disposed within a carrier sized and shaped to receive one or more delivery bins. The locking system further includes a first retention feature disposed on the bin and configured to receive the latch in a first locked configuration where horizontal and vertical movement of the bin relative to the latch is prohibited. Additionally, the locking system includes a second retention feature disposed on the bin distal to the first retention feature and configured
(Continued)

to receive the latch in a second locked configuration. The second retention feature has an opening such that, in the second locked configuration, vertical movement of the bin relative to the latch is permitted to thereby remove the bin from the latch through the opening.

14 Claims, 6 Drawing Sheets

(56) References Cited

U.S. PATENT DOCUMENTS 4,822,116 A * 4/1989 Relyea ..... A47B 67/04 312/249.11
4,865,404 A * 9/1989 Harper ..... E05B 65/463 312/328
4,925,257 A * 5/1990 Frederiksen ..... E05B 65/463 312/221
5,205,630 A * 4/1993 Welch ..... A47B 47/021 211/187
5,314,243 A * 5/1994 McDonald ..... G07F 11/62 312/249.11
5,915,803 A * 6/1999 Daugherty ..... A47B 67/04 312/265.5
6,378,963 B1 * 4/2002 Relyea ..... B60B 33/025 312/351.13
6,732,662 B2 * 5/2004 Welch ..... F24C 15/16 312/334.44
6,746,091 B2 * 6/2004 Friar ..... A61G 12/001 312/218
8,335,588 B2 * 12/2012 Rahilly ..... G07F 17/0092 700/242
9,536,359 B1 1/2017 Gokcebay
9,622,574 B2 * 4/2017 Kabacinski ..... B62B 3/006
9,635,779 B2 * 4/2017 Mine ..... H05K 7/1418
9,861,194 B1 * 1/2018 Park ..... A47B 67/04
2001/0045449 A1 11/2001 Shannon
2005/0180844 A1 * 8/2005 Uekert ..... G01R 31/01 414/788.1
2011/0156560 A1 * 6/2011 Michael ..... E05B 47/00 312/319.1
2013/0146553 A1 * 6/2013 Preidt ..... A47F 5/137 211/153
2014/0294328 A1 * 10/2014 Pecar ..... A47B 88/467 384/20
2016/0000221 A1 * 1/2016 Brunner ..... A47B 31/00 312/249.8
2016/0037918 A1 * 2/2016 Greer ..... A47B 31/00 312/283
2016/0235197 A1 * 8/2016 Kabacinski ..... B62B 3/005
2017/0065082 A1 * 3/2017 Janzen ..... A47B 88/447
2018/0008498 A1 * 1/2018 Sciacchitano ..... E05B 65/44
2018/0192771 A1 * 7/2018 Takahashi ..... A47B 31/00
2018/0231257 A1 * 8/2018 Rehage ..... A47B 88/473
2020/0230822 A1 * 7/2020 Sohmshetty ..... B25J 5/06

FOREIGN PATENT DOCUMENTS

EP 3381325 A1 * 10/2018 ..... A47B 88/427
FR 2852448 A1 * 9/2004 ..... G06K 13/08
JP 2001002212 A * 1/2001
RU 2702307 C2 * 10/2019 ..... E02D 5/54
WO 2003093997 A1 11/2003
WO WO-2021227625 A1 * 11/2021 ..... A23N 12/02

* cited by examiner

LOCKING SYSTEM FOR RETRACTABLE AND REMOVABLE DELIVERY BIN

BACKGROUND

Delivery bins are used to store goods therein, and may be delivered to a target location via, e.g., a mobile robot. However, in a situation where the robot is intended to deliver a bin/package to a human user, the user must be able to retrieve the package from the target bin, which may be difficult if there are other bins located above the target bin that are blocking the lid of the target bin. Accordingly, the target bin may be retractable to thereby expose the lid of the bin. However, if the actuation of the bin requires manual input, e.g., via a button or remote device, the user may not have enough time to input the command before the bin reaches the end of the conveyer of the robot and falls off the conveyor. Moreover, when the bin is actuated forward to a position along the conveyor in which the user can retrieve the goods contained therein, it would be beneficial to allow the user to be able to completely remove the bin without requiring the user to use one hand to input a command, such that the user has both hands free to handle the bin. Any solution that addresses manual removal by a user preferably also still protects for autonomous bin swapping between robots.

It is with respect to these and other considerations that the disclosure made herein is presented.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Figure 1:
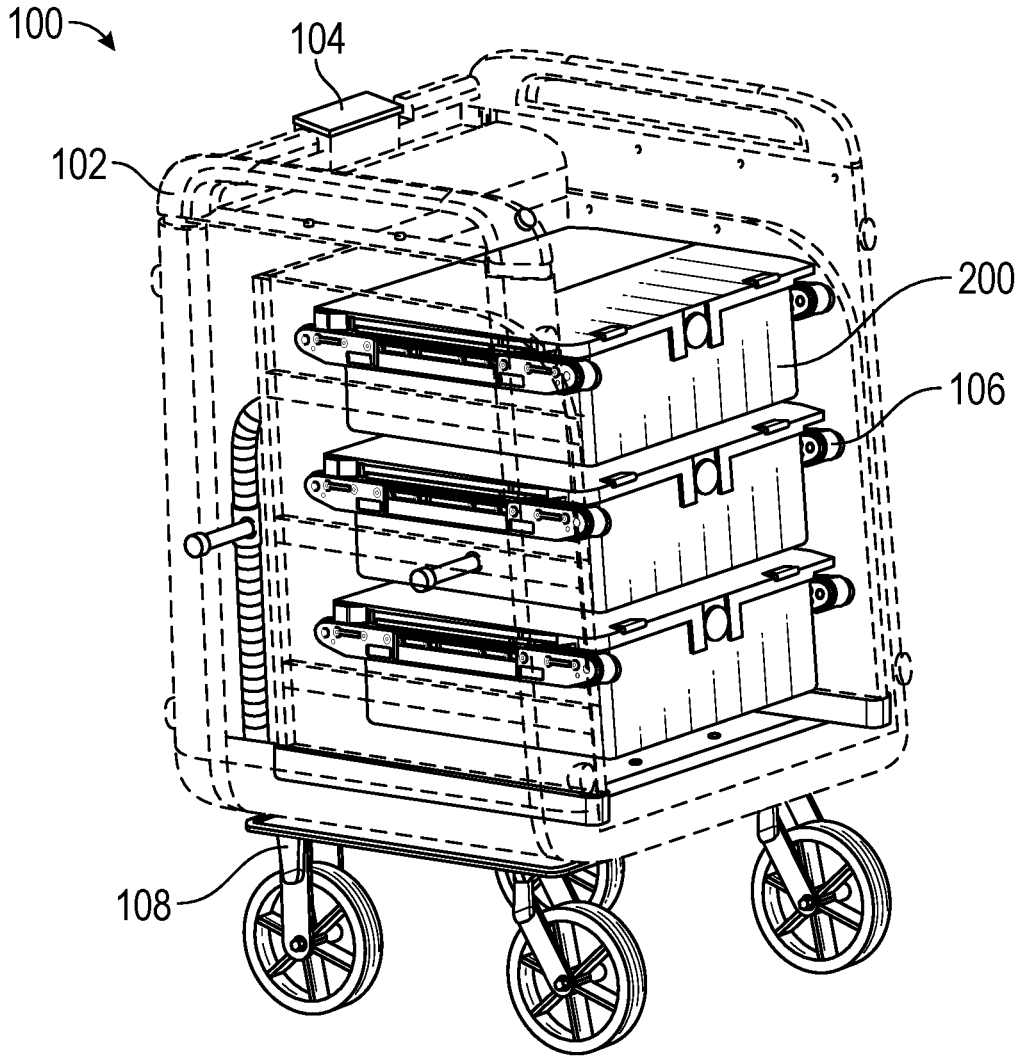
FIG. 1 illustrates exemplary retractable and removable delivery bins disposed in a robot in accordance with the principles of the present disclosure.

Disclosed is a locking system for retractable and removable bins, e.g., goods delivery bins. A retractable latch, e.g., a solenoid latch, with manual locking and electronic unlocking, and positioned at the end of a conveyer would allow a bin to be stopped at point along the conveyor at which a user may retrieve the goods disposed within the bin. The solenoid latches may sit within a grooved, retention feature of the bin. The bins are symmetrical about the x-axis (axis perpendicular to the conveyer). In the home position of the bin, the bin will be prevented from being removed (along the y-axis) when the solenoid latch meets a front locking feature of the bin. A rear locking feature will be engaged when the bin reaches the point along the conveyor in which the user may retrieve the items from within the bin. Moreover, at this point when the rear locking feature is engaged, the bin may be removed from the conveyor along the y-axis, e.g., by lifting the bin up. Specifically, an opening at the bottom of the rear retention feature allows the bin to be removed from the latch; whereas, the front retention feature does not have an opening at the bottom, thereby securely locking the bin relative to the latch.

The systems described herein do not require electronic intervention for a user to insert a bin onto the conveyor, e.g., a conveyor of a robot, and engage the locks due to latch-style solenoids. A user is able to lift the bin out of locking position once it has been actuated forward to the second locking position (when the rear locking feature is engaged). This protects manual user exchanges as well as for robot-to-robot exchanges for the ultimate goal of end-to-end goods delivery. When integrated into a vehicle, a user may remove the goods without fulling removing the bin and/or remove the entire bin if desired. Symmetrical bins allows 180 degree rotationally invariant placement onto conveyers, as well as protects for future swaps from both directions.

Illustrative Embodiments

The disclosure will be described more fully hereinafter with reference to the accompanying drawings, in which example embodiments of the disclosure are shown. This disclosure may, however, be embodied in many different forms and should not be construed as limited to the example embodiments set forth herein. It will be apparent to persons skilled in the relevant art that various changes in form and detail can be made to various embodiments without departing from the spirit and scope of the present disclosure. Thus, the breadth and scope of the present disclosure should not be limited by any of the above-described example embodiments but should be defined only in accordance with the following claims and their equivalents. The description below has been presented for the purposes of illustration and is not intended to be exhaustive or to be limited to the precise form disclosed. It should be understood that alternate implementations may be used in any combination to form additional hybrid implementations of the present disclosure. For example, any of the functionality described with respect to a particular device/component may be performed by another device/component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments.

Certain words and phrases are used herein solely for convenience and such words and terms should be interpreted as referring to various objects and actions that are generally understood in various forms and equivalencies by persons of ordinary skill in the art.

Referring now to FIG. 1, an exemplary robotic package delivery system is provided. Delivery system 100 may include a robot including a carrier, e.g., tophat 102, configured to deliver one or more delivery bins 200. Tophat 102 may swap delivery bins 200 autonomously with other corresponding robots or wall receptacles. As shown in FIG. 1, tophat 102 may be disposed on mobile robotic base 108 having a plurality of wheels, which may be actuated via one or more motors to navigate the robot.

Delivery bins 200 may be retractable relative to tophat 102 via conveyors 106. As shown in FIG. 1, tophat 102 may include, for each delivery bin, a pair of conveyors 106. For example, one conveyor may be disposed on an interior right side wall of tophat 102, and another conveyor may be disposed on an interior left side wall of tophat 102. Accordingly, delivery bin 200 may slidably engage with the pair of conveyors 106, such that delivery bin 200 may be retracted from tophat 102 to permit a user to remove the goods stored therein.

Conveyors 106 may be actuated to cause a belt of the conveyor to rotate about the conveyor to thereby move delivery bin 200. For example, the belt of conveyors 106 may be actuated to move in a forward direction (away from the rear of tophat 102) such that delivery bin 200 is retracted outward to permit a user to access the interior of delivery bin 200 to remove the goods stored therein and/or insert goods therein. Further, the belt of conveyors 106 may be actuated to move in a backward direction (toward the rear of tophat 102) such that delivery bin 200 is retracted inward to secure delivery bin 200 within tophat 102 in a delivery configuration.

In addition, the robot may include user interface 104, which may be disposed in an accessible portion of tophat 102 for ease of access by a user. User interface 104 may have one or more actuators to permit the user to actuate one or more functions of the robot. For example, the user may actuate user interface 104 to electrically unlock delivery bin 200 from tophat 102, as described in further detail below, and cause delivery bin 200 to retract outward. Moreover, after the user has removed the goods within delivery bin 200, the user may actuate user interface 104 to retract delivery bin 200 inward in a delivery configuration. User interface 104 may further be actuated by the user to cause mobile robotic base 108 to navigate the robot to the next target delivery location.

Figure 2A:
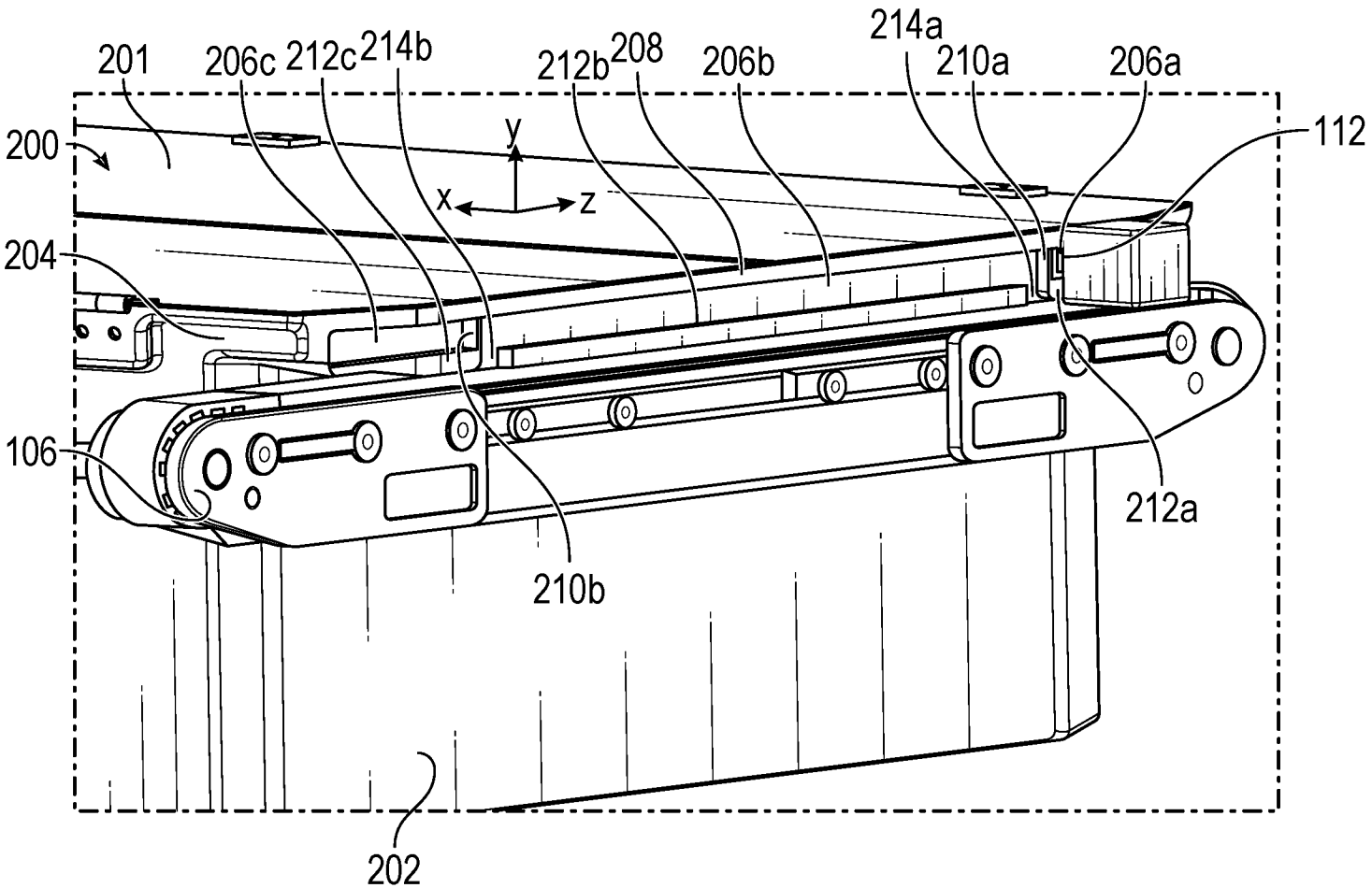
FIG. 2A illustrates an exemplary locking system for the retractable and removable delivery bin constructed in accordance with the principles of the present disclosure.
Figure 2B:
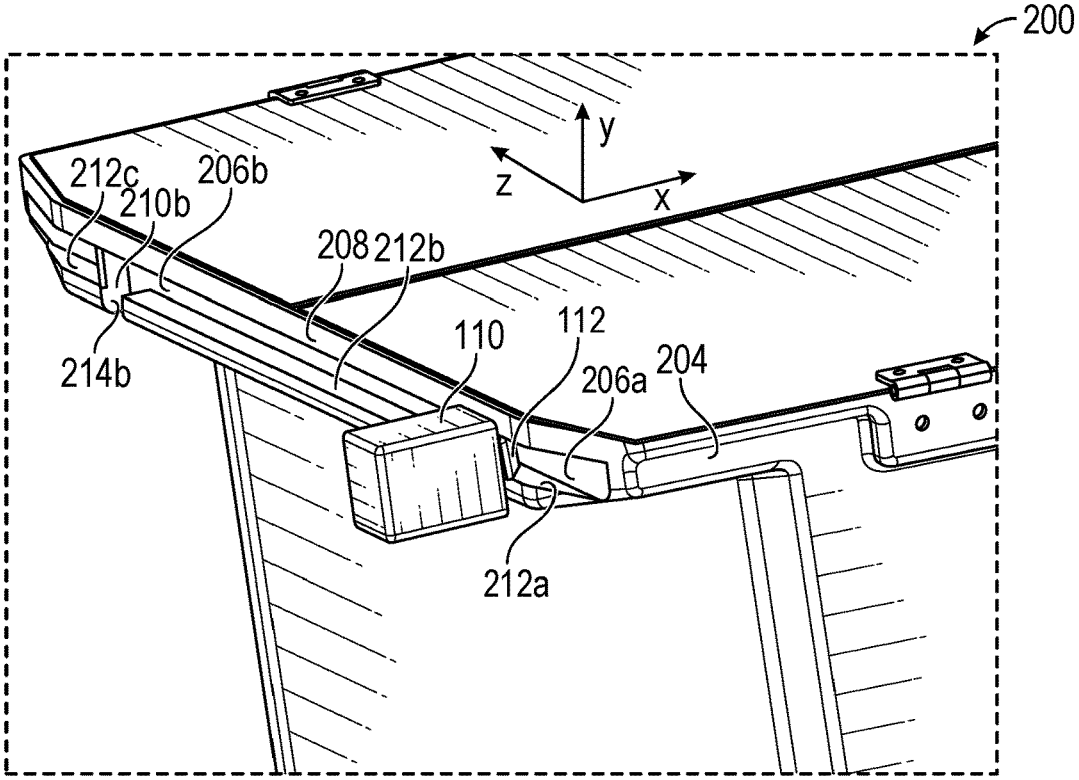
FIG. 2B is a front perspective view of the retractable and removable delivery bin in a first locked configuration.

Referring now to FIGS. 2A and 2B, an exemplary locking system for delivery bin 200 is provided. As shown in FIG. 2A, delivery bin 200 includes lid 201, which may be coupled to the upper portion of base 202 of delivery bin 200 via a plurality of hinges, such that a user may easily open lid 201 to access the interior of base 202 of delivery bin 200. Base 202 may be sized and shaped to store a plurality of goods/items/packages. Moreover, delivery bin 200 may include ledge 204 extending laterally along the x-axis (perpendicular to conveyor 106) from an upper edge of a lateral side of delivery bin 200, such that delivery bin 200 may sit on top of conveyor 106 via ledge 204 for retraction of delivery bin 200. As described in further detail below, the locking components of delivery bin 200 may be disposed on ledge 204.

As shown in FIGS. 2A and 2B, ledge 104 of delivery bin 200 includes first retention feature 206*a*, second retention feature 206*b*, and third retention feature 206*c*. Delivery bin 200 may be symmetrical about the x-axis, such that third retention feature 206*c* mirrors first retention feature 206*a*. First, second, and third retention features 206*a-c* may be respective grooves extending into ledge 204, and defined by upper lip 208, lower lips 212*a*, 212*b*, and 212*c*, respectively, and front locking wall 210*a* and rear locking wall 210*b*. For example, first retention feature 206*a* may be a groove defined by upper lip 208, lower lip 212*a*, and the front face of front locking wall 210*a*. Similarly, third retention feature 206*c* may be a groove defined by upper lip 208, lower lip 212*c*, and the rear face of rear locking wall 210*b*.

Second retention feature 206*b* may be a groove defined by upper lip 208, lower lip 212*b*, the rear face of front locking wall 210*a*, and the front face of rear locking wall 210*b*. As shown in FIGS. 2A and 2B, lower lip 212*b* may include front opening 214*a* adjacent to the rear face of front locking wall 210*a*, and rear opening 214*b* adjacent to the front face of rear locking wall 210*b*. As delivery bin 200 is symmetrical about the x-axis, rear opening 214*b* is a mirror of front opening 214*a*, and rear locking wall 210*b* is a mirror of front locking wall 210*a*. Front and rear openings 214*a* and 214*b* are sized and shaped to permit latch 112 to pass therethrough, as described in further detail below.

Figure 3:
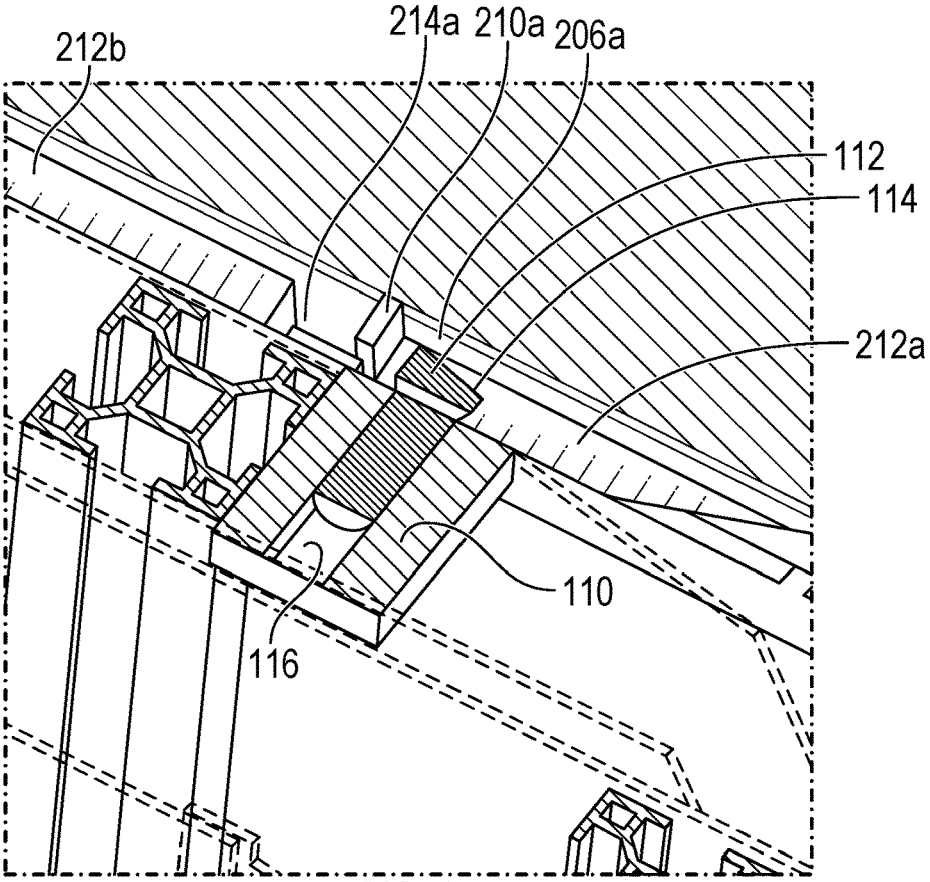
FIG. 3 is a cross-sectional view of an exemplary solenoid latch constructed in accordance with the principles of the present disclosure.

Referring now to FIG. 3, an exemplary retractable latch is provided. As shown in FIG. 3, the locking system of delivery system 100 may include retractable latch 112, e.g., a solenoid latch, retractably disposed within housing 110. Housing 110 may be fixedly coupled to an upper portion of a front portion of conveyor 106, such that the belt of conveyor 106 may still move between conveyor 106 and the underside of housing 110 along the z-axis. Latch 112 may transition between an extended locked position where latch 112 extends outwardly from housing 110 toward ledge 204 along the x-axis, and a retracted unlocked position wherein latch 112 is substantially completely disposed within housing 110. In the retracted unlocked position, delivery bin 200 may move relative to housing 110 without front locking wall 210*a* colliding with latch 112 and preventing horizontal movement of delivery bin 200 relative to latch 112 along the z-axis. Latch 112 may be operatively coupled to user interface 104, such that actuation of user interface 104 may cause latch 112 to electrically transition from the extended locked position to the retracted unlocked position.

Moreover, as shown in FIG. 3, outward edge 114 of latch 112 may have an angled surface. For example, outward edge 114 may be sloped such that the rear edge of latch 112 is longer than the front edge of latch 112. Accordingly, in the extended locked position, the rear edge of latch 112 will engage with the front face of front locking wall 210*a*, such that front locking wall 210*a* prevents forward horizontal movement of delivery bin 200 relative to latch 112 (away from the rear of tophat 102) along the z-axis. The rear wall of tophat 102 prevents backward horizontal movement of delivery bin 200 relative to latch 112 (toward the rear of tophat 102) along the z-axis. However, when latch 112 is in its extend locked position adjacent to the rear face of front locking wall 210*a*, forward horizontal movement of delivery bin 200 relative to latch 112 will cause the sloped outward edge 114 of latch 112 to engage with front locking wall 210*a*, such that front locking wall 210*a* causes latch 112 to mechanically transition from its extended locked position to its retracted unlocked position within housing 110 along sloped outward edge 114.

Figure 4A:
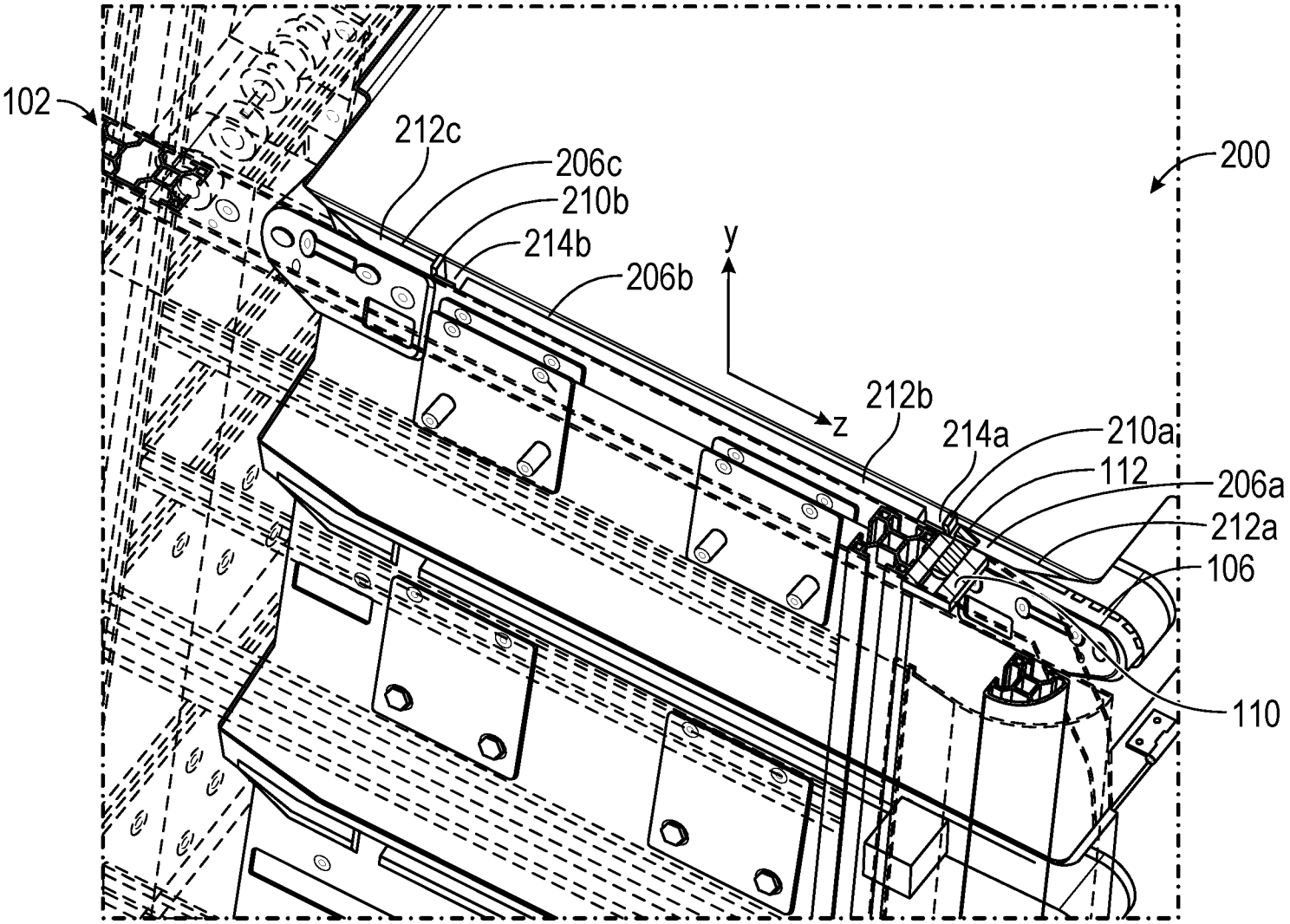
FIG. 4A is a cross-sectional view of the exemplary retractable and removable delivery bin in the first locked configuration along the conveyor of the robot.
Figure 4B:
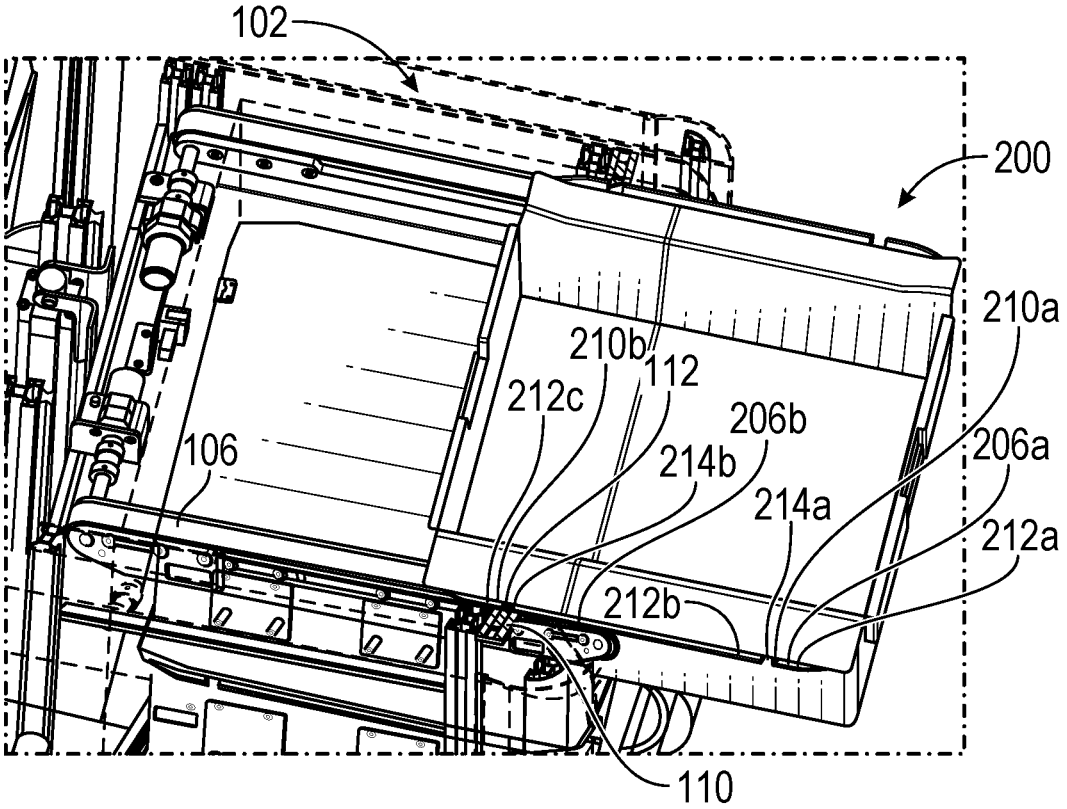
FIG. 4B is a cross-sectional view of the exemplary retractable and removable delivery bin in a second locked configuration along the conveyor of the robot.

Referring now to FIGS. 4A and 4B, retraction of delivery bin 200 between first and second locked configurations are described. FIG. 4A illustrates delivery bin 200 in a first locked configuration wherein latch 112 is in its extended locked position and disposed within first retention feature 206*a*. As described above, the front face of front locking wall 210*a* engages with latch 112, thereby preventing forward horizontal movement of delivery bin 200 relative to latch 112 along the z-axis. Backward horizontal movement of delivery bin 200 relative to latch 112 is prevent via the rear wall of tophat 102. To retract delivery bin 200 outward, latch 112 is electronically actuated to transition from its extended locked position to its retracted unlocked position, and conveyors 106 are electrically actuated to move delivery bin 200 from a first position relative to latch 112 in the first locked configuration, horizontally forward along the z-axis to a second position relative to latch 112 where latch 112 is adjacent to the front face of rear locking wall 210*b*.

Latch 112 may be electrically actuated to transition from the its extended locked position to its retracted unlocked position for a predetermined amount of time, e.g., the minimum amount of time it takes for front locking wall 210*a* to move horizontally forward past latch 112. Accordingly, once front locking wall 210*a* is forward of latch 112, latch 112 may return to its extended locking position within second retention feature 206*b*. Delivery bin 200 may continue to move horizontally forward via conveyor 106 until latch 112 engages with the front face of rear locking wall 210*b* in a second locked configuration, as shown in FIG. 4B, where rear locking wall 210*b* prevents further forward horizontal movement of delivery bin 200 relative to latch 112. In the second locked configuration, lid 201 of delivery bin 200 is sufficiently exposed from tophat 102 such that a user may open lid 201 and access the interior of delivery bin 200. Accordingly, second retention feature 206*b* may have a length sufficiently long enough such that in the second locked configuration, lid 201 is accessible by the user. Additionally, in the second locked configuration, the weight distribution of delivery bin 200 is such that delivery bin remains on top of conveyor 106.

The user may remove delivery bin 200 entirely from tophat 102, if necessary, in the second locked configuration. To remove delivery bin 200 from conveyor 106, the user simply lifts delivery bin 200 vertically upward along the y-axis, such that latch 112, in its extended locked position, passes through rear opening 214*b*. Once lower lip 212*b* is vertically above the top surface of latch 112, delivery bin 200 may be manually moved horizontally forward until it may be safely removed from tophat 102 without colliding with any other bins, if any. If delivery bin 200 is the highest bin within tophat 102, such that there are no bins above delivery bin 200, delivery bin 200 may simply be lifted vertically upward in the second locked configuration to remove delivery bin 200 from tophat 102.

If the user does not need to remove delivery bin 200 from tophat 200, and simply would like to retract delivery bin 200 inward in the delivery configuration, user interface 104 may be actuated to cause conveyors 106 to move delivery bin 200 horizontally inward. As described above, when sloped outward edge 114 of latch 112 engages with the rear face of front locking wall 210*a*, forward horizontal movement of delivery bin 200 relative to latch 112 will cause latch 112 to mechanically transition from its extended locked position to its retracted unlocked position within housing 110 along sloped outward edge 114. Once latch 112 is forward of front locking wall 210*a*, latch 112 will return to its extended lock position within retention feature 206*a*, to thereby secure delivery bin 200 within tophat 102.

In addition, delivery bin 200 may be symmetric about the x-axis along its centerline, such that the opposite lateral side of delivery bin 200 also includes a ledge having locking components that mirror ledge 204 and the locking component therein, which may sit on top of the other conveyor of the pair of conveyors 106 associated with delivery bin 200, and engage with a corresponding latch. Accordingly, delivery bin 200 may be rotated 180 degrees and still engage with the pair of conveyors 106 of tophat 102. Thus, first retention feature 206*a* will be in the position of the third retention feature that mirrors third retention feature 206*c* when delivery bin 200 is rotated 180 degrees.

Figure 5:
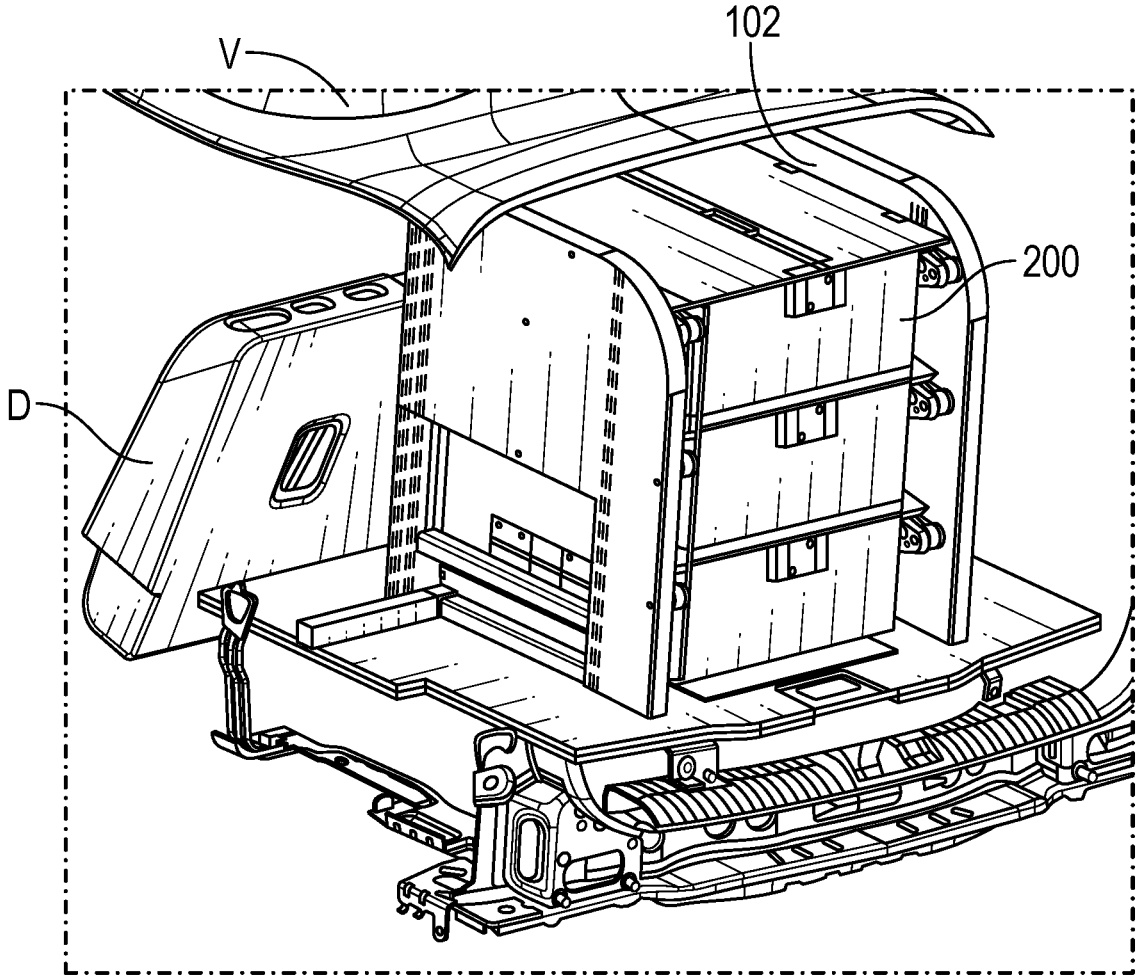
FIG. 5 illustrates alternative exemplary retractable and removable delivery bins disposed within a smart vehicle in accordance with the principles of the present disclosure.

Referring now to FIG. 5, another exemplary delivery system is provided. As shown in FIG. 5, tophat 102 may be disposed within a smart truck or vehicle V, adjacent to the rear of the truck or vehicle V, instead of on a robotic mobile base. Accordingly, when vehicle V has reached the target destination, door D may be actuated to open to expose tophat 102 and delivery bins 200 disposed therein. Delivery bins 200 may be similarly retracted and removed from tophat 102 of vehicle V in accordance with the methods described herein.

In the above disclosure, reference has been made to the accompanying drawings, which form a part hereof, which illustrate specific implementations in which the present disclosure may be practiced. It is understood that other implementations may be utilized, and structural changes may be made without departing from the scope of the present disclosure. References in the specification to "one embodiment," "an embodiment," "an example embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, one skilled in the art will recognize such feature, structure, or characteristic in connection with other embodiments whether or not explicitly described.

Implementations of the systems, apparatuses, devices, and methods disclosed herein may comprise or utilize one or more devices that include hardware, such as, for example, one or more processors and system memory, as discussed herein. An implementation of the devices, systems, and methods disclosed herein may communicate over a computer network. A "network" is defined as one or more data links that enable the transport of electronic data between computer systems and/or modules and/or other electronic devices. When information is transferred or provided over a network or another communications connection (either hardwired, wireless, or any combination of hardwired or wireless) to a computer, the computer properly views the connection as a transmission medium. Transmission media can include a network and/or data links, which can be used to carry desired program code means in the form of computer-executable instructions or data structures and which can be accessed by a general purpose or special purpose computer. Combinations of the above should also be included within the scope of non-transitory computer-readable media.

Computer-executable instructions comprise, for example, instructions and data which, when executed at a processor, cause the processor to perform a certain function or group of functions. The computer-executable instructions may be, for example, binaries, intermediate format instructions, such as assembly language, or even source code. Although the subject matter has been described in language specific to structural features and/or methodological acts, it is to be understood that the subject matter defined in the appended claims is not necessarily limited to the described features or acts described above. Rather, the described features and acts are disclosed as example forms of implementing the claims.

Those skilled in the art will appreciate that the present disclosure may be practiced in network computing environments with many types of computer system configurations, including in-dash vehicle computers, personal computers, desktop computers, laptop computers, message processors, handheld devices, multi-processor systems, microprocessor-based or programmable consumer electronics, network PCs, minicomputers, mainframe computers, mobile telephones, PDAs, tablets, pagers, routers, switches, various storage devices, and the like. The disclosure may also be practiced in distributed system environments where local and remote computer systems, which are linked (either by hardwired data links, and/or wireless data links) through a network, both perform tasks. In a distributed system environment, program modules may be located in both the local and remote memory storage devices.

Further, where appropriate, the functions described herein may be performed in one or more of hardware, software, firmware, digital components, or analog components. For example, one or more application specific integrated circuits (ASICs) may be programmed to carry out one or more of the systems and procedures described herein. Certain terms are used throughout the description, and claims refer to particular system components. As one skilled in the art will appreciate, components may be referred to by different names. This document does not intend to distinguish between components that differ in name, but not function.

At least some embodiments of the present disclosure have been directed to computer program products comprising such logic (e.g., in the form of software) stored on any computer-usable medium. Such software, when executed in one or more data processing devices, causes a device to operate as described herein.

While various embodiments of the present disclosure have been described above, it should be understood that they have been presented by way of example only, and not limitation. It will be apparent to persons skilled in the relevant art that various changes in form and detail can be made therein without departing from the spirit and scope of the present disclosure. Thus, the breadth and scope of the present disclosure should not be limited by any of the above-described example embodiments but should be defined only in accordance with the following claims and their equivalents. The foregoing description has been presented for the purposes of illustration and description. It is not intended to be exhaustive or to limit the present disclosure to the precise form disclosed. Many modifications and variations are possible in light of the above teaching. Further, it should be noted that any or all of the aforementioned alternate implementations may be used in any combination desired to form additional hybrid implementations of the present disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

What is claimed:

1. A locking system for a retractable and removable delivery bin, the locking system comprising:

a retractable latch disposed within a carrier sized and shaped to receive a retractable and removable delivery bin;

a first retention feature disposed on the delivery bin and configured to receive the retractable latch in a first locked configuration where horizontal and vertical movement of the delivery bin relative to the retractable latch is prohibited; and a second retention feature disposed on the delivery bin distal to the first retention feature and configured to receive the retractable latch in a second locked configuration, the second retention feature comprising an opening such that, in the second locked configuration, vertical movement of the delivery bin relative to the retractable latch is permitted to thereby remove the delivery bin from the retractable latch through the opening.

2. The locking system of claim 1, wherein the retractable latch comprises a solenoid latch.

3. The locking system of claim 1, wherein the retractable latch is configured to be actuated to transition between an extended locked position and a retracted unlocked position, wherein the retractable latch is in the extended locked position in the first and second locked configurations.

4. The locking system of claim 3, wherein the retractable latch is configured to be electrically actuated to transition between the extended locked position and the retracted unlocked position.

5. The locking system of claim 3, wherein the retractable latch comprises a sloped edge such that horizontal movement of the delivery bin from the first locked configuration to the second locked configuration is prohibited when the retractable latch is in the extended locked position, and horizontal movement of the delivery bin from the second locked configuration to the first locked configuration causes the retractable latch to transition from the extended locked position to the retracted unlocked position via the sloped edge of the retractable latch.

6. The locking system of claim 1, wherein the first retention feature is separated from the second retention feature via a locking wall, the locking wall configured to prohibit horizontal movement of the delivery bin from the first locked configuration to the second locked configuration when the retractable latch is in an extended locked position.

7. The locking system of claim 1, wherein the delivery bin is symmetric about an axis perpendicular to an axis extending between the first and second retention features.

8. The locking system of claim 7, wherein the delivery bin is symmetric about an axis parallel to an axis extending between the first and second retention features, such that the delivery bin may be rotated 180 degrees relative to the carrier.

9. The locking system of claim 1, wherein the delivery bin comprises a ledge extending outwardly along an upper portion of the delivery bin, and wherein the first and second retention features are disposed along the ledge.

10. The locking system of claim 9, wherein the ledge comprises an upper lip, a lower lip, and a locking wall extending therebetween, the upper lip, lower lip, and locking wall defining the first and second retention features.

11. The locking system of claim 10, wherein, in the first locked configuration, the retractable latch is positioned between the upper lip and the lower lip, proximal to the locking wall, such that the upper lip and the lower lip prohibits vertical movement of the delivery bin relative to the retractable latch and the locking wall prohibits horizontal movement of the delivery bin relative to the retractable latch.

12. The locking system of claim 10, wherein the opening is formed in the lower lip of the ledge, such that, in the second locked configuration, the retractable latch is positioned between the upper lip and the opening, proximal to the locking wall.

13. A bin retractable and removable from a carrier, the bin comprising:

a first retention feature configured to receive a retractable latch of the carrier in a first locked configuration where horizontal and vertical movement of the bin relative to the retractable latch is prohibited;

a second retention feature distal to the first retention feature and configured to receive the retractable latch in a second locked configuration, the second retention feature comprising an opening such that, in the second locked configuration, vertical movement of the bin relative to the retractable latch is permitted to thereby remove the bin from the retractable latch through the opening.

14. The bin of claim 13, wherein the bin is symmetric about an axis perpendicular to an axis extending between the first and second retention features.

* * * * *